United States Patent [19]

Dinius et al.

[11] 4,366,111

[45] Dec. 28, 1982

[54] METHOD OF HIGH FIBER THROUGHPUT SCREENING

[75] Inventors: James H. Dinius; Raymond Chung, both of Neenah, Wis.

[73] Assignee: Kimberly-Clark Corporation, Neenah, Wis.

[21] Appl. No.: 268,174

[22] Filed: May 29, 1981

Related U.S. Application Data

[63] Continuation-in-part of Ser. No. 106,143, Dec. 21, 1979, abandoned.

[51] Int. Cl.[3] ..... B29J 5/00

[52] U.S. Cl. ..... 264/518; 264/121

[58] Field of Search ..... 264/518, 121

[56] References Cited

U.S. PATENT DOCUMENTS

| | | | |
|---|---|---|---|
| 2,447,161 | 8/1948 | Caghill | 162/290 |
| 2,748,429 | 6/1956 | Clark | 19/156 |
| 2,751,633 | 6/1956 | Clark | 19/156 |
| 2,810,940 | 10/1957 | Mills | 19/155 |
| 2,931,076 | 4/1960 | Clark | 19/156 |
| 3,575,749 | 4/1971 | Kroger | 156/62.2 |
| 3,581,706 | 6/1971 | Rasmussen | 118/312 |
| 3,669,778 | 6/1972 | Rasmussen | 156/62.2 |
| 3,692,622 | 9/1972 | Dunning | 161/124 |
| 3,733,234 | 5/1973 | Dunning | 156/209 |
| 3,764,451 | 10/1973 | Dunning | 425/81.1 |
| 3,769,115 | 10/1973 | Rasmussen et al. | 156/62.2 |
| 3,776,807 | 12/1973 | Dunning et al. | 428/170 |
| 3,825,381 | 7/1974 | Dunning et al. | 425/83 |
| 3,976,412 | 8/1976 | Attwood et al. | 425/81 |
| 4,060,360 | 11/1977 | Tapp | 425/83 |
| 4,074,393 | 2/1978 | Hicklin | 19/303 |

FOREIGN PATENT DOCUMENTS 1088991 10/1967 United Kingdom .

*Primary Examiner*—James R. Hall

*Attorney, Agent, or Firm*—Gregory E. Croft; William D. Herrick

[57] ABSTRACT

Method for improving fiber throughput in a high speed production system for forming an air-laid web of dry fibers and wherein individual fibers are separated from aggregated fiber masses in an enclosed, pressurized rotor chamber comprising forming a segment of the chamber wall with a plurality of closely spaced, elongated, narrow slots oriented parallel to the axis of the rotor chamber.

9 Claims, 9 Drawing Figures fig. 3
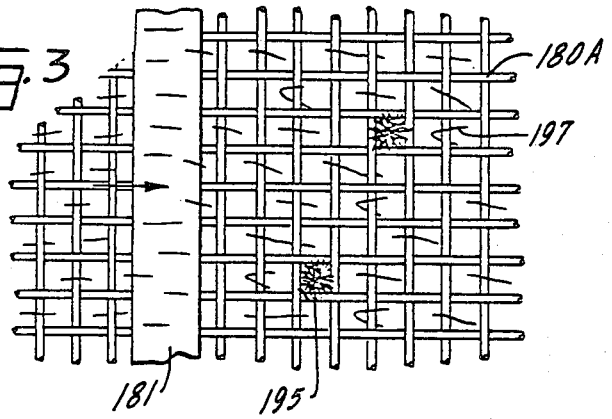
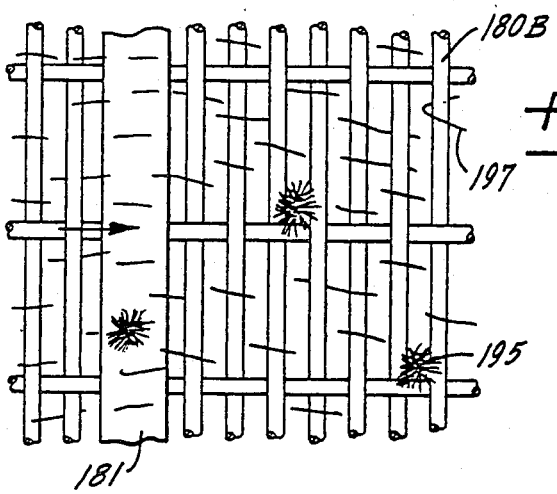
fig. 4
fig. 5
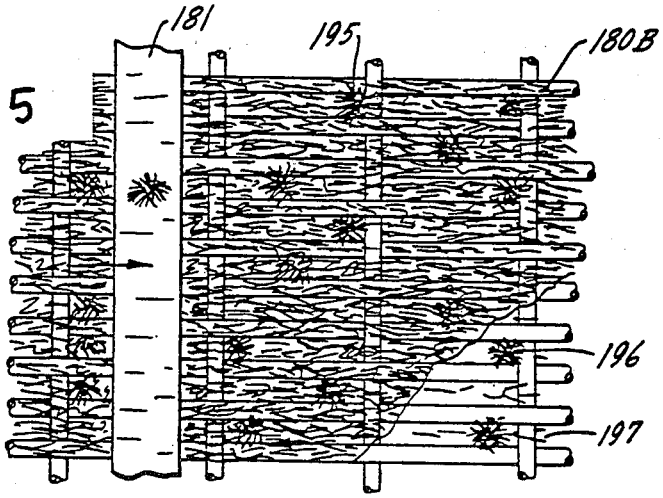

METHOD OF HIGH FIBER THROUGHPUT SCREENING

RELATED APPLICATIONS

This application is a continuation-in-part of Ser. No. 106,143, filed Dec. 21, 1979, now abandoned.

David W. Appel and Raymond Chung Ser. No. 250,546, filed Apr. 3, 1981, for "Method and Apparatus for Forming An Air-Laid Web" which is a continuation-in-part of Ser. No. 106,144, filed Dec. 21, 1979 now abandoned.

James H. Dinius, Ser. No. 266,753 filed May 26, 1981 for "Method for Forming a Fibrous Web With High Fiber Throughput Screening," which is a continuation-in-part of Ser. No. 106,142 filed Dec. 21, 1979, now abandoned.

Raymond Chung Ser. No. 250,545, filed Apr. 3, 1981, for "System for Forming an Air-Laid Web of Dry Fibers", which is a continuation-in-part of Ser. No. 106,141, filed Dec. 21, 1979 now abandoned.

BACKGROUND OF THE INVENTION

The present invention relates in general to a method for forming nonwoven fabrics; and, more particularly, to a method for improving the fiber throughput capacity of 2-dimensional systems for forming air-laid webs of dry fibers on a high-speed production basis; yet, wherein the web being formed is characterized by a random dispersion of essentially undamaged, uncurled, individualized fibers disposed in a controlled cross-directional profile and is substantially devoid of nits, pills, rice and other aggregated fiber masses so as to result in a web of aesthethetically pleasing appearance and increased tensile strength, irrespective of the 10 basis weight of the web.

Conventionally, materials suitable for use as disposable tissue and towel products have been formed on papermaking equipment by water-laying a wood pulp fibrous sheet at speeds exceeding 5,000 feet per minute. Following formation of the sheet, the water is removed either by drying or by a combination of pressing and drying. As water is removed during formation, surface tension forces of very great magnitude develop which press the fibers into contact with one another, resulting in overall hydrogen bonding at substantially all fiber intersections. The hydrogen bonds between fibers provide sheet strength but result in very unfavorable tactile properties and low bulk characteristics.

To improve these unfavorable properties, water-laid sheets are typically creped from the dryer roll, reforming the flat sheet into a corrugated-like structure, thereby increasing its bulk and simultaneously breaking a significant portion of the fiber bonds, thus artificially improving the tactile and absorbency properties of the material. However, creping is most effective on low (less than about 15 lbs./2800 ft.$^2$) basis weight webs. When a higher basis weight is desired, it is conventional practice to employ at least two plies of creped low basis weight paper sheets for such uses.

Conventional paper-making methods possess the inefficient attribute of initial "overbonding", which then necessitates a creping step to partially "debond" the sheet, and have extreme water requirements which create an associated water pollution problem. Still further, the essential drying procedures consume tremendous amounts of energy.

Air forming of wood pulp fibrous webs has been carried out for many years; however, the resulting webs have been used for applications where either little strength is required, such as for absorbent products—i.e., pads—or applications where a certain minimum strength is required but the tactile and absorbency properties are unimportant—i.e., various specialty papers. U.S. Pat. No. 2,447,161 to Coghill, U.S. Pat. No. 2,810,940 to Mills, and British Pat. No. 1,088,991 illustrate various air-forming techniques for such applications.

In the late 1940's and early 1950's, work by James D'A. Clark resulted in the issuance of a series of patents directed to systems employing rotor blades mounted within a cylindrical fiber "disintegrating and dispersing chamber" wherein air-suspended fibers were fed to the chamber and discharged from the chamber through a screen onto a forming wire—viz., J. D'A. Clark U.S. Pat. Nos. 2,748,429, 2,751,633 and 2,931,076. However, Clark and his associates encountered serious problems with these types of forming systems as a result of disintegration of the fibers by mechanical co-action of the rotor blades with the chamber wall and/or the screen mounted therein which caused fibers to be "rolled and formed into balls or rice which resist separation"—a phenomenon more commonly referred to today as "pilling". Additionally, J. D'A. Clark encountered problems producing a web having a uniform cross-direction profile, because the fiber input and fiber path through the rotary former was not devoid of cross flow forces.

A second type of system for forming air-laid webs of dry cellulosic fibers which has found limited commercial use has been developed by Karl Kristian Kobs Kroyer and his associates as a result of work performed in Denmark. Certain of these systems are described in: Kroyer U.S. Pat. Nos. 3,575,749 and 4,014,635; Rasmussen U.S. Pat. Nos. 3,581,706 and 3,669,778; Rasmussen et al. U.S. Pat. No. 3,769,115; Attwood et al. U.S. Pat. No. 3,976,412; Tapp U.S. Pat. No. 4,060,360; and, Hicklin et al. U.S. Pat. No. 4,074,393.

This type of sifting equipment suffers from poor productivity especially when making tissue-weight webs. For example, the rotor action concentrates most of the incoming material at the periphery of the blades where the velocity is at a maximum. Most of the sifting action is believed to take place in these peripheral zones, while other regions of the sifting screen are either covered with more slowly moving material or are bare. Thus, a large percentage of the sifting screen area is poorly utilized and the system productivity is low. Moreover, fibers and agglomerates tend to remain in the forming head for extended periods of time, especially in the lower velocity, inner regions beneath the rotor blades. This accentuates the tendency of fibers to roll up into pills.

In an effort to overcome the productivity problem of such systems, complex production systems have been devised utilizing multiple forming heads—for example, up to eight separate spaced forming heads associated with multiple hammermills and each employing two or three side-by-side rotors. The most recent sifting type systems employing on the order of eighteen, twenty or more rotors per forming head, still require up to three separate forming heads in order to operate at satisfactory production speeds—that is, the systems employ up to fifty-four to sixty, or more, separate rotors with all of the attendant complex drive systems, feed arrangements, recycling equipment and hammermill equipment.

During the 1970's a series of patents were issued to C. E. Dunning and his associates which have been assigned to the assignee of the present invention; such patents describing yet another approach to the formation of air-laid dry fiber webs. Such patents include; Dunning U.S. Pat. Nos. 3,692,622, 3,733,234 and 3,764,451; and, Dunning et al. U.S. Pat. Nos. 3,776,807 and 3,825,381. However, this system requires preparation of preformed rolls of fibers having high cross-directional uniformity and is not suitable for use with bulk or baled fibrous materials, such that, to date, the system has found only limited commercial application.

Indeed, heretofore it has not been believed that air-forming techniques can be advantageously used in high speed production operations to prepare cellulosic sheet material that is sufficiently thin, and yet has adequate strength, together with softness and absorency, to serve in applications such as bath tissues, facial tissues and light weight toweling.

SUMMARY OF THE INVENTION

In the present invention there is a method disclosed for forming an air-laid web of dry fibers having a basis weight of from 7.5 to 50 pounds per 2880 square feet. Dry fibrous materials suspended in an air stream are provided to a rotary forming head, which is provided with a forming chamber and which has a plurality of rotor bars rotating about a horizontal axis therein.

The dry fibers are dispersed throughout the forming head in a rapidly moving air stream which maintains the fibrous materials free of grinding forces while within the forming head. From 1% to 10% of the fibrous materials are separated from the aerated bed and dishcarged from the forming head, these being aggregated fiber masses having a bulk density greater than 0.2 g/cc. The individualized fibers and soft fiber flocs are discharged from the forming head through a high capacity slotted screen at a rate of at least 0.5 lbs/hour per square inch of screen surface. The fibers are conveyed from the forming head to a moving foraminous forming surface through an enclosed forming zone.

The method of the present invention is selected so as to introduce a quantity of dry fibers to a forming head which are conveyed through the forming head to the forming surface with the air/fiber suspension being maintained substantially free of cross-flow forces from the time the fibers are dispersed in the forming head until the web is formed on the forming wire.

The fibrous materials are conveyed through the forming head in an air stream by the rotating rotor bars, which rotate at approximately twice the speed of the air-fiber stream, thereby creating a negative pressure wake behind each rotor bar. This negative pressure zone is at least as great as the pressure drop across the screen member, which results from a positive pressure in the forming head of from 0.5" to 3.0"0 of water.

DESCRIPTION OF THE DRAWINGS

These and other objects and advantages of the present invention will become more readily apparent upon reading the following detailed description and upon reference to the attached drawings, in which:

FIG. 3 is a diagrammatic plan view indicating in schematic, idealized fashion fiber movement through a conventional woven square-mesh screen under the influence of air movement and rotor action;

FIG. 4 is a view similar to FIG. 3 but here depicting movement of fibers through a high capacity slotted screen in which the slots are oriented parallel to the axis of the rotor in accordance with the invention;

FIG. 5 is a view similar to FIG. 4, but here illustrating the undesirable plugging action that occurs when the slots of a slotted screen are oriented in a direction generally perpendicular to a plane passing through the axis of the rotor;

Figure 1:
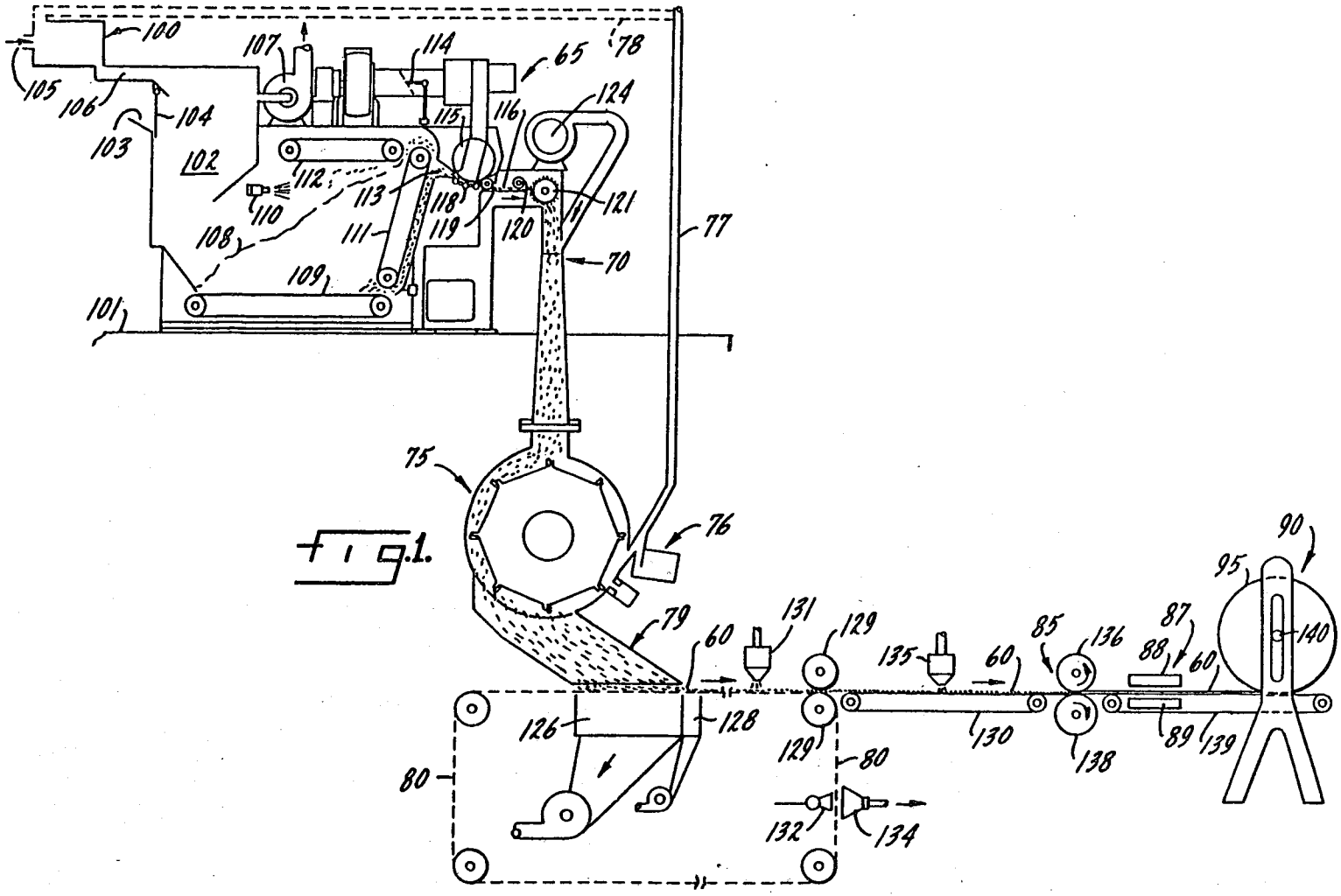
FIG. 1 is a schematic view, in side elevation, of one form of apparatus for the formation of a web in accordance with the present invention.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

DETAILED DESCRIPTION

To facilitate an understanding of the ensuing description and the appended claims, definitions of certain selected terms and phrases as used throughout the specification and claims are set forth below.

The words "nit", "pill" and/or "rice" are herein each used to describe a dense, rolled up bundle of fibers, often including bonded fibers, which are generally formed by mechanical action during fiber transport or in a rotor chamber where the fibers are commonly subjected to mechanical disintegrating action.

The terms "floc" and "soft floc" are herein used to describe soft, cloud-like accumulations of fibers which behave like individualized fibers in air; i.e., they exhibit relatively high co-efficients of drag in air.

The phrase "aggregated fiber masses" is herein used to generically embrace pulp lumps, pills, rice and/or nits, and to describe aggregations of bonded and/or mechanically entangled fibers generally having a bulk density on the order of greater than 0.2 grams per cubic centimeter (g./cc.).

The phrase "2-dimensional" is used to describe a system for forming a web wherein: (i) the cross-section of the system and the flows of air and fiber therein are the same at all sections across the width of the system; and (ii), where each increment of system width behaves essentially the same as every other increment of system width.

B. Overall System Description

Referring to FIG. 1, there has been illustrated an exemplary system for forming an air-laid web 60 of dry fibers, such system embodying the features of the invention disclosed and claimed in the aforesaid application of David W. Appel and Raymond Chung, Ser. No. 106,144, filed Dec. 21, 1979, and comprising: a fiber metering section, 65; a fiber transport or eductor section, generally indicated at 70; a forming head, generally indicated at 75, where provision is made for controlling air and fiber flow, and where individual fibers are screened from undesirable aggregated fiber masses and, thereafter, are air-laid on a foraminous forming wire 80; a suitable bonding station, generally indicated at 85, where the web is bonded to provide strength and integrity; a drying station, generally indicated at 87, where the bonded web 60 is dried prior to storage; and, a take-up or reel-type storage station, generally indicated at 90, where the air-laid web 60 of dry fibers is, after bonding and drying, formed into suitable rolls 95 for storage prior to delivery to some subsequent processing operation (not shown) where the web 60 can be formed into specifically desired consumer products.

In order to permit continuous removal of aggregated fiber masses, the forming head 75 includes a separator system, generally indicated at 76. Such separated aggregated fiber masss and individualized fibers entrained therewith are preferably removed from the forming area by means of a suitable conduit 77 maintained at a pressure level lower than the pressure within the forming head 75 by means of a suction fan (not shown). The conduit 77 may convey the masses to some other area (not shown) for use in inferior products, for scrap, or, alternatively, the undesirable aggregated fiber masses may be recycled and subjected to secondary mechanical disintegration prior to reintroduction into fiber meter 65. Finally, the forming head 75 also includes a forming chamber, generally indicated at 79, positioned immediately above the foraminous forming wire 80. Thus, the arrangement is such that individual fibers and soft fiber flocs pass through the forming chamber79 and are deposited or air-laid on the forming wire 80 to form a web 60 characterized by its controlled cross-directional profile and basis weight.

While various types of commercially available fiber metering systems can, with suitable modifications, be employed with equipment embodying the features of the present invention, one system which has been found suitable and which permits of the necessary modifying adaptations is a RANDO-FEEDER (a registered trademark of the manufacturer, Rando Machine Corporation, Macedon, N.Y.).

As heretofore indicated, fibers are air-laid on the foraminous forming wire 80 at the forming station by means of an air stream generated primarily by a fan (not shown). In addition, a vacuum box 126 positioned immediately below the forming wire 80 and the web forming section 79 serves to maintain a positive downwardly moving stream of air which assists in collecting the web 60 on the moving wire 80. If desired, a second supplementary vacuum box 128 may be provided beneath the forming wire at the point where the web 60 exits from beneath the forming chamber 79, thereby insuring that the web is maintained flat against the forming wire.

After formation, the web 60 is passed through calender rolls 129 to lightly compact the web and give it sufficient integrity to permit ease of transportation to conveyor belt 130. A light waterspray can be applied from nozzle 131 in order to counteract static attraction between the web and the wire. An air shower 132 and vacuum box 134 serve to clean loose fibers from the wire 80 and thus prevent fiber build-up.

After transfer to the belt 130, the web 60 may be bonded in any known conventional manner such as spraying with adhesives such as latex, overall calendering to make a saturating base paper, adhesive print pattern bonding, or other suitable process. Such bonding processes do not form part of the present invention and, therefore, are neither shown nor described in detail herein, but, such processes are well known to those skilled in the art of nonwoven fabric manufacture. For example, the web 60 may be pattern bonded in the manner described in greater detail in the aforesaid Dunning U.S. Pat. No. 3,692,622 assigned to the assignee of the present invention. Subsequently, the bonded web 60 is transferred to conveyor belt 139 and transported thereby through the drying station 87 to the storage station 90 where the web 60 is taken up on a driven reel 140 to form roll 95 which may thereafter be either stored for subsequent use or unwound at a subsequent web processing station (not shown) to form any desired end product.

Multiple forming heads for increasing overall productivity of the air-laid dry fiber web forming system may be utilized. As a consequence of this construction, the speed of the forming wire may be increased by a multiple of the number of forming heads employed to form a composite web 60 of a selected basis weight for a given forming wire speed.

In carrying out the present invention, it has been found advantageous to make provision for forming a full-width feed mat of fibers having a controlled cross-directional profile in terms of the mass quantum of fibers constituting the mat. The air-to-fiber ratio preferably employed when working which cellulosic wood fibers is on the order of 200-600 cubic feet of air (at standard temperature and atmospheric pressure conditions) per pound of fiber. Moreover, when employing the exemplary equipment herein described such air is supplied at relatively high volumes which vary dependent upon the operational speed of the rotor assembly and the types of fibers being worked with—i.e., volumes ranging from 1,000 to 1,800 $ft.^3$/min./ft. of former width are conventional when working with cellulosic wood fibers.

In operation, the air-suspended fiber stream is conveyed through a suitable fiber transport duct 170 (FIG. 2) from the full-width eductor 70 to a fullwidth inlet slot 171 formed in the upper surface of, and extending fully across, a generally cylindrical housing 172 which here defines the 2-dimensional flow control, screening and separating zone 75. The duct 170 is preferably subdivided into a plurality of side-by-side flow channel separated by partitions 174 extending the full length of the duct.

Figure 2:
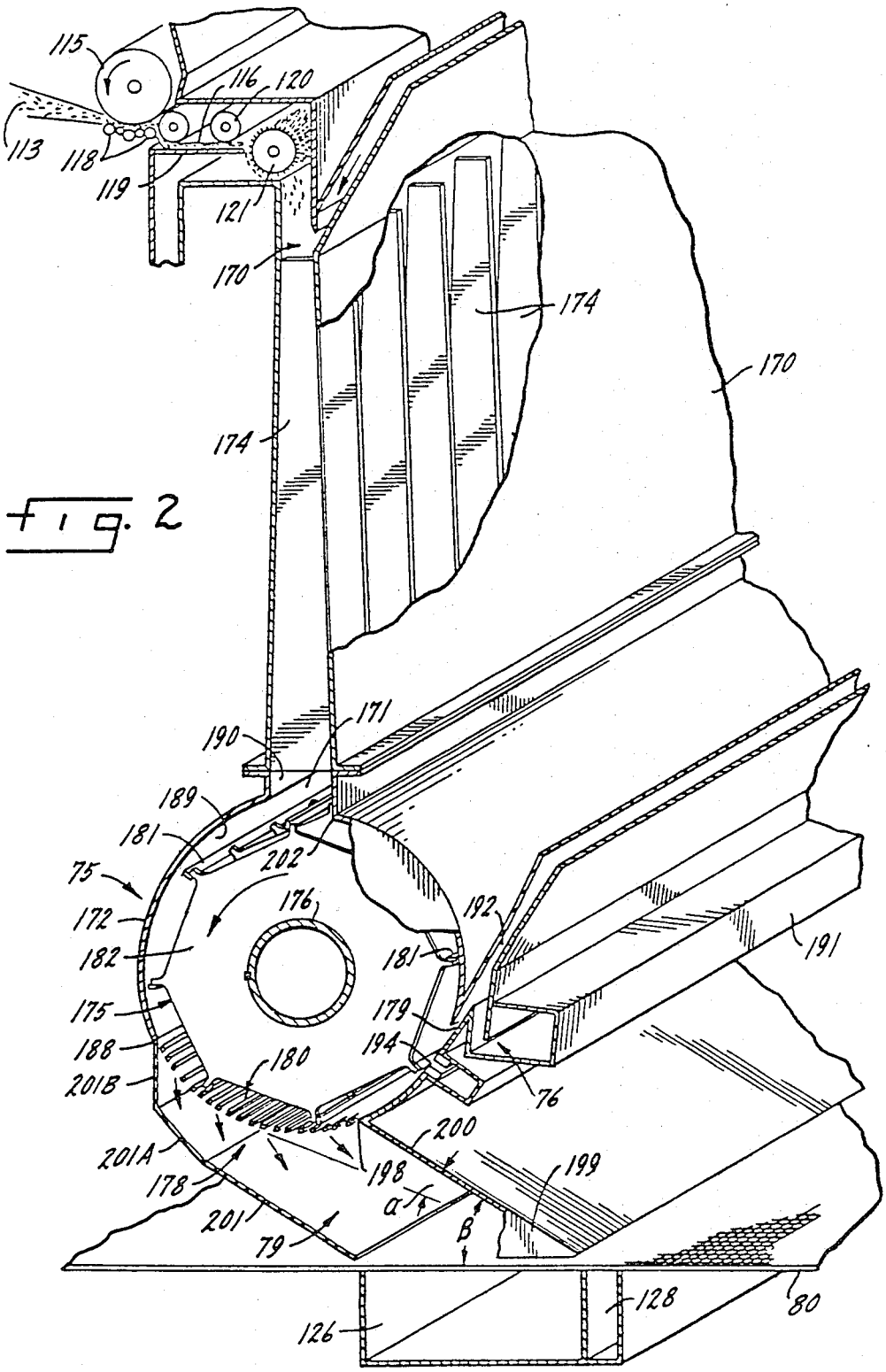
FIG. 2 is an oblique view, partially cut away, here schematically illustrating details of an emboidment of the invention shown generally in FIG. 1.
Figure 7:
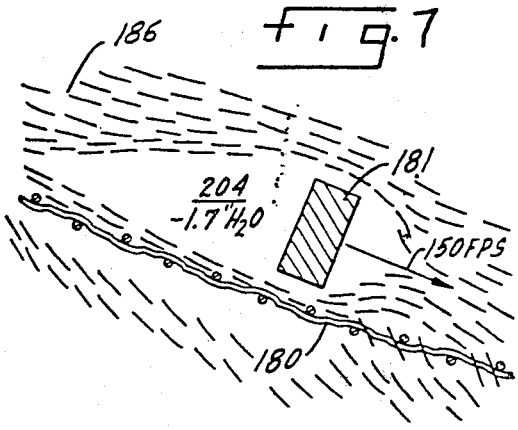
FIG. 7 is a highly enlarged view of a portion of the system shown diagrammatically in FIG. 6.

In carrying out the invention, a 2-dimensional cylindrical rotor former includes a rotor assembly, generally indicated at 175 in FIG. 2 mounted for rotation within housing 172 about a horizontal axis defined by shaft 176. The arrangement is such that the air-suspended fiberous materials introduced radially into housing 172 through the inlet slot 171 are conveyed by co-action of the air stream and the rotor assembly 175 through the housing 172 for controlled and selective discharge either (a) through a full-width discharge opening, 20 generally, indicated at 178 in FIG. 2, and into forming zone 79 for ultimate, air-laid deposition on forming wire 80, or alternatively, (b) through a full-width tangential separator slot 179 formed in housing 172 downstream of the discharge opening 178. The separator slot 179, which here forms part of the separation and/or recycle zone 76 (FIGS. 1 and 2), is preferably on the order of from 3/16" to ⅜" in circumferential width when working with wood fibers and, if desired, may be adjustable in any conventional manner (not shown) so as to permit circumferential widening or narrowing of the slot 179 to optimize separation conditions.

To permit controlled, selective discharge of individualized fibers and soft fiber flocs through opening 178 and into forming zone 79, while at the same time precluding discharge of nits and other undesired aggregated fiber masses therethrough, suitable screening means, generally indicated at 180 in FIG. 2, is mounted within discharge opening 178. Such screening means 180 may, in accordance with the invention disclosed and claimed in the aforesaid application of David W. Appel and Raymond Chung, Ser. No. 250,546, filed Apr. 3, 1981, simply take the form of a conventional woven squaremesh wire screen of the type shown at 180A in FIG. 3 and having openings sized to preclude passage of aggregated fiber masses—e.g., the screen may take the form of an 8×8 mesh screen having 64 openings per square inch, a 10×10 mesh screen, a 12×12 mesh screen, or other commonly available woven mesh screens. As best shown in FIG. 2, screening means 180 is formed with the same radius of curvature as the semi-cylindrical portion of housing 172 within which discharge opening 178 is formed. As a result of rotor bar movement and the high velocity movement of the air stream, the air and fibers tend to move outwardly towards the wall of housing 172, thus forming an annular, rotating aerated bed of fibrous materials, best illustrated at 186 in FIG. 6. Such annular aerated bed 186 of fibrous materials is believed to be on the order of one-half inch to one and one-half inches thick (dependent upon actual operating parameters), and is believed to be moving rotationally at about half the speed of the rotor bars 181. For example, in a cylindrical former having an inside housing diameter of 24" where the rotor assembly 175 is being driven at 1432 RPM, the tip velocity of the rotor bars 181 is on the order of 150 f.p.s. (feet/second) and, consequently, it is believed that the velocity of the aerated bed 186 is on the order of 80 f.p.s.

The rotor assembly 175 is preferably designed so as to minimize mechanical action between the rotor bars 181 and both the housing 172 and screening means 180, which tends to disintegrate fibers and aggregated fiber masses carried in the air stream and to generate pills. To this end, the rotor bars 181 are mounted so as to provide a clearance between the outer edges of the bars 181 and the inner wall surface of the housing 172 and screening means 180 of from 0.10 inches to 0.25 inches. To avoid generation of cross-flow forces, it is important that the rotor bars 181 re continuous, extend the full width of the rotor chamber, and are oriented parallel to the axis of the rotor assembly 175.

Referring again to FIG. 2, it will be apparent from the description as thus far set forth, that as air-suspended fibers are introduced radially into the rotor housing 172 through inlet slot 171, they are moved rapidly through the housing under the influence of the air stream and movement of the rotor bars 181, thus forming the moving annular aerated bed 186 of fibers (FIG. 6) about the inner periphery of the housing wall. As the aerated bed—which contains individualized fibers, soft fiber flocs, nits and other aggregated fiber masses—passes over the screening means 180, some, but not all, of the individualized fibers and soft fiber flocs pass through the screening means into the forming zone 79, while the balance of the individualized fibers and soft fiber flocs, together with nits and other aggregated fiber masses, pass over the screen without exiting from the rotor housing 172. The undesired pills, rice and nits—i.e., aggregated fiber masses—have a bulk density generally in excess of 0.2 g/cc. and tend to be separated along with some individualized fibers and soft fiber flocs from the aerated bed 186 at the tangential separator slot 179, with those separated materials being centrifugally expelled through the slot 179 where they are entrained in a recycle or separating air stream generated by any suitable means (not shown) coupled to manifold 191 with the air-suspended separated particles moving outward through a full-width discharge passage 192 coupled to separator slot 179 and, ultimately, to conduit 77 (FIG. 1). Such separation is aided by a positive air outflow from housing 172 through separator slot 179.

In order to insure aggregated fiber masses are discharged, and individualized fibers are not, a full-width classifying air jet 194 is provided upstream of the separator slot 179 and downstream of screening means 180. The air jet 194 tends to divert individualized fibers and soft fiber flocs within the aerated bed 186 radially inward as a result of the relatively high drag coefficients of such materials and their relatively low bulk density (which is generally on the order of less than 0.2 g./cc.). Since the nits and aggregated fiber masses have a relatively high bulk density in excess of 0.2 g./cc. and relatively low drag coefficients, the classifying air stream introduced through the full-width air jet 194 does not divert such materials to any significant extent and, therefore, such undesired materials tend to be centrifugally expelled through the tangential separator slot 179. It has been found that the introduction of classifying air through the full-width classifying air jet 194 into housing 172 at pressures on the order of from 50" to 100" $H_2O$ and at volumes ranging from 1.5 to 2.5 $ft.^3$/min./in. provides an energy level adequate for deflecting a significant portion of the individualized fibers and soft fiber flocs. The energy level of the classifying air jet is most conveniently controlled by adjusting its pressure. In operation, it has been found that excellent results are obtained by limiting the amount of fibrous material removed from the system through separator slot 179 to less than 10% by weight and, preferably, to between 1% and 5% by weight, of the fibrous material introduced into the housing 172 through inlet slot 171.

In order to maximize throughput in a system as described above a high-capacity slotted screen 180B of the type shown in FIG. 4 is mounted within discharge opening 178 with the screen slots oriented with their long dimensions parallel to the axis of rotor assembly 175. When utilizing a slotted type screen 180B with a 2-dimensional rotor assembly 175 mounted for rotation about a horizontal axis, it has been found essential that the screen slots be oriented with their long dimensions parallel to the axis of the rotor assembly. When so oriented, individualized fibers tend to move through the screen slots while nits and aggregated fiber masses—e.g., the aggregated fiber masses 195 shown in FIG. 4—are precluded from passing through the screen since they are generally larger in size then the narrow dimensions of the slots which may range between 0.02" and 0.1" open space from wire-to-wire in at least one direction and, preferably, ranges between 0.045" and 0.085" open space from wire-to-wire in at least one direction. Such wire-to-wire dimensions are particularly critical when the system is being used to make high quality, lightweight tissue webs—e.g., webs having low nit levels and basis weights ranging from 13 lbs./2880 ft.$^2$ to 18 lbs./2880 ft.$^2$ and, in some instances, up to 22–25 lbs./2880 ft.$^2$. However, when the slots of a slotted screen 180B are oriented with their long dimensions perpendicular to a plane passing through the rotor axis as shown in FIG. 5, it has been found that the screen tends to rapidly plug-indeed, when operating under commercial production conditions, it has been found that the screen tends to become completely plugged almost instantaneously. It is believed that such plugging action results from the tendency of individual fibers to "staple" or "hair-pin" and otherwise hang up or collect within the narrow confines at the end of each slot as best indicated at 196 to the lower right-hand corner of FIG. 5; and, as soon as a few fibers have collected, other fibers and aggregated fiber masses 195 almost instantaneously agglomerate on the screen as depicted in the balance of FIG. 5.

On the other hand, it has been found that a conventional woven square-mesh screen of the type shown at 180A in FIG. 3, and a slotted screen 180B with the slots oriented as shown in FIG. 4, exhibit little or no tendency to plug under normal operating conditions. Rather, while individualized fibers still have a tendency to "staple" or "hair-pin", as indicated at 197 in FIGS. 3 and 4, there seems to be adequate time and room for the suspended fibers to disengage themselves from the screen; whereas in the arrangement shown in FIG. 5 the suspended fibers tend to catch and congregate in the closely proximate confined corners of the screen slot and, as a result, other fibers and aggregated fiber masses 195 rapidly accumulate, thus plugging the screen and rendering the system inoperative.

In the illustrative form of the invention, the rotor bars 181 have a rectangular cross-section, and pumping action is minimized by keeping the effective rotor bar area relatively small—e.g., $\frac{3}{4}$" times the length of the bars which extend across the full width of the rotor housing 172—and by spacing the bars apart circumferentially by 45° (there being eight equally spaced bars) and from the housing 172 by on the order of 0.18" to 0.20". However, the rotor bars 181 need not be rectangular in cross-section. Rather, they can be circular, vane-shaped, or of virtually any other desired cross-sectional configuration not inconsistent with the objective of minimizing rotor pumping action. For example, rotor bars having a circular cross-section would, because of their shape, be even more effective than rectangular bars in terms of minimizing rotor pumping action. However, the primary function of the rotor assembly as employed in the present invention is to lift individualized fibers, soft fiber flocs, and aggregated fiber masses off the surface of the former screening means by the negative pressure zones created in the wakes of the moving rotor bars and, thereby, to prevent plugging of the screen, to prevent layering of fibers on the screen, and to reopen apertures in the screen so as to permit passage of the air-suspended fiber stream therethrough.

It is significant to a complete understanding of the present invention that one understand the difference between the primary function of the rotor assembly here provided—to lift fibrous materials upwardly and off the screen by momentarily disrupting passage of the air-suspended fiber stream through the screen—and that stated for conventional cylindrical rotor systems of the type disclosed, in the J. D'A. Clark patents where the rotor chamber functions as a "disintegrating and dispersing chamber" (See, e.g., col. 4, line 53, J. D'A. Clark U.S. Pat. No. 2,931,076).

In keeping with another important aspect of the present invention, provision is made for insuring that individualized fibers passing through the screening means 180 shown in FIG. 3 are permitted to move directly to the foraminous forming wire 80 without being subjected to cross-flow forces, eddy currents or the like, thereby maintaining cross-directional control of the mass quantum of fibers delivered to the forming wire through the full-width of forming zone 79. To accomplish this, provision is made for insuring that the upstream, downstream and side edges of the forming zone are formed so as to define an enclosed forming zone and to thereby preclude intermixing of ambient air with the air/fiber stream exiting housing 172 through screening means 180. It has been found that the air/fiber stream exiting from housing 172 through screening means 180 does not exit radially but, rather at an acute angle or along chordal lines or vectors which, on average, tend to intersect a line tangent to the mid-point of the screening means 180 at an included angle $\alpha$. In the exemplary form of the invention where the screening means 180 covers an arc of approximately 86°—i.e., an arc extending clockwise as viewed in FIG. 3 from a point (indicated at 198 in FIG. 2 approximately 159° from the center of inlet slot 171 to a point 188 approximately 245° from the center of inlet slot 171—and, where an 8-bar rotor is being operated at a rotor speed on the order of 1400–1450 RPM, it has been found that the angle $\alpha$ is generally on the order of 11°.

The walls 199, 200 and 201 serve to enclose the forming zone 79 and to thereby preclude disruption of the air/fiber stream as a result of mixing between ambient air and the air/fiber stream. The enclosed forming zone 79 is preferably maintained at or near atmospheric pressure so as to prevent inrush and outrush of air and to thereby assist in precluding generation of cross-flow forces within the forming zone. Those skilled in the art will appreciate that angle $\alpha$ can vary with changes in operating parameters such, for example, as changes in rotor RPM. However, for operation at or near optimum conditions, it is believed that the angle $\alpha$ will generally lie within the range of 5° to 20° and, preferably, will lie within the range of 8° to 15°. The lower edges of forming walls 200, 201 terminate slightly above the surface of foraminous forming wire 80—generally terminating on the order of from one-quarter inch to one and one-quarter inches above the wire.

In the exemplary form of the invention shown in FIG. 2, when the angle $\alpha$ is on the order of 11° and when the forming zone 79 is positioned over a horizontal forming surface 80, the upstream and downstream forming walls lies in planes which intersect the horizontally disposed forming surface 80 at included acute angles $\beta$ where $\beta$ is on the order of 33°. However, those skilled in the art will appreciate that the angular value of $\beta$ is not critical and can vary over a wide range dependant only upon the orientation of the forming surface 80 relative to the forming zone 79.

Numerous system parameters may be varied in the operation of a forming system embodying the features of the present invention in order to form an air-laid web of dry fibers having specific desired characteristics. Such variable parameters include, for example: air-to-fiber ratio (which is, preferably 200–600 ft.$^3$/lb. when working with cellulosic wood fibers, and preferably 1000 to 3000 ft.$^3$/lb., and perhaps higher, when working with cotton linters and relatively long synthetic fibers); air pressure within housing 172 (which preferably varies from +0.5" to +3.0" $H_2O$); rotor speed (which preferably varies from 800 to 1800 RPM); the number, orientation and shape of rotor bars employed; the quantity of air supplied per foot of former width (which is, preferably, on the order of 1500 to 1650 ft.$^3$/min. with an 8-bar rotor operating at 1432 RPM); the energy level of classifying air supplied (which preferably ranges from 1.5 to 2.5 ft.$^3$/min./in. or, stated in terms of pressure, preferably ranges from 50" to 100" $H_2O$); recycle or separation balance (which is less than 10% by weight of the fiber supplied and, preferably, from 1% to 5% by weight of the fiber supplied); screen design—viz., whether the screen is a woven square-mesh screen or a slotted screen, the size of the screen openings (which ranges between 0.02" and 0.1" wire-to-wire open space in at least one direction and, preferably, ranges between 0.045" and 0.085" open space from wire-to-wire in at least one direction), the wire diameter used (which preferably varies from on the order of 0.023" to 0.064") and, the percentage of open screen area (which is between 30% and 55% and, preferably varies from 38% to 46%); air pressure within the enclosed forming zone 79 (which is preferably atmospheric); as well as the physical dimensions of the forming head 75 (which, in the exemplary form of the invention, comprises a generally cylindrical housing 172 having an inside diameter of 24").

Still another variable parameter under the control of the operator is the cross-directional profile of the feed mat delivered to the forming head 75. If one desires to produce an air-laid web having a specific non-uniform cross-directional profile—e.g., an absorbent filler web having a central portion with a relatively high basis weight and marginal edges of relatively low basis weights—it is merely necessary to form feed mats having the requisite cross-directional profile and, since the present system is substantially devoid of cross-directional forces, the cross-directional profile of the input feed mat(s) will control the cross-directional profile of the air-laid web.

Recognizing the foregoing, let it be assumed that the operator wishes to form an air-laid web 60 one foot (1') in width (all ensuing assumptions are per one foot of width of the forming head 75) having a controlled uniform cross-directional profile and a basis weight of 17 lbs./2880 ft.$^2$. Assume further:

(a) Air-to-fiber ratio supplied through inlet slot 171 equals 350 ft.$^3$/lb.

(b) Inlet slot 171 is 5" in circumferential width—i.e., the dimension from edge 190 (FIG. 2) to edge 202.

(c) Rotor housing 172 is 24" I.D.

(d) Rotor assembly 175 employs eight equally spaced rectangular rotor bars 181, each $\frac{3}{4}$" in radial heigh by $\frac{3}{8}$" in circumferential thickness and extending parallel to the axis of the rotor assembly continuously throughout the full width of rotor housing 172 and, each spaced from the rotor housing 172 by 0.18".

(e) Rotor assembly 175 is driven at 1432 RPM.

(f) Rotor bar 181 tip velocity equals 150 f.p.s.

(g) Relative velocity between the rotor bars 181 and the aerated bed 186 is approximately 70 f.p.s.

(h) Screening means 180 defines an arc of 86°, and has 40% open area.

(i) Separation and/or recycle through separator slot 179 comprises 5% by weight of fibrous materials supplied through inlet slot 171.

(j) The quantity of classifying air introduced through air jet 194 is between 1.5 and 2.5 ft.$^3$/min./in. at pressures between 50" and 100" $H_2O$.

(k) Forming walls 200, 201 are parallel and spaced 9" apart in a direction normal to the parallel walls 200, 201 and 16" apart in a horizontal plane passing through their lower extremities just above the plane of the forming wire 80.

(l) Forming wire speed equals 750 f.p.m.

All of the foregoing operating parameters are either fixed and known, or can be pre-set by the operator, except for the relative velocity between the rotor bars 181 and the aerated bed 186 of fibers within the rotor housing 172. The actual speed of the aerated bed 186 is not known with certainty; but, it is believed to be substantially less than the rotor bar tip velocity of 150 f.p.s.; and, more particularly, it is believed to be on the order of half the tip velocity of the rotor bars 181. For convenience, it is here assumed to be approximately 80 f.p.s., an assumption believed to be reasonably accurate based upon observation of overall system behavior, thereby resulting in a relative velocity between the rotor bars 181 and the aerated bed 186 of approximately 70 f.p.s. (see assumption "g", supra).

Accordingly, supply and velocity relationships within the foregoing exemplary system can be readily calculated as follows: and, such relationships have been illustrated in FIG. 10:

| | | | |
|---|---|---|---|
| $\frac{17}{2880} \times 750$ | = | 4.43 lbs./min. - Rate of formation of web 60. | [I] |
| $4.43 \times 1.05$ | = | 4.65 lbs./min. - Rate of fiber supply through inlet slot 171. | [II] |
| $4.65 \times 350$ | = | 1627 ft.$^3$/min. - Vol. of air supplied through inlet slot 171. | [III] |
| $2\pi \times \frac{86°}{360°}$ | = | 1.5 ft. - Screen circumference. | [IV] |
| $1.5' \times 1' \times 144$ in.$^2$/ft.$^2$ | = | 216 in.$^2$ - Screen area. | [V] |
| $\frac{4.43 \times 60 \text{ min.}}{216 \text{ in.}^2}$ | = | 1.23 lbs./hr./in.$^2$ - Fiber throughput of former screen 180. | [VI] |
| 1.5 ft.$^2 \times 40\%$ | = | 0.6 ft.$^2$ - Amount of open area in screen 180. | [VII] |
| $\frac{1627}{5/12 \times 60}$ | = | 65 f.p.s. - Velocity of air and fiber stream entering rotor housing 172 through inlet slot 171. | [VIII] |
| $\frac{1627}{1.5 \times 60}$ | = | 18 f.p.s. - Velocity approaching the screen 180 (i.e., normal to the screen). | [IX] |
| $\frac{1627}{0.6 \times 60}$ | = | 45 f.p.s. - Velocity through screen openings. | [X] |
| $\frac{1627}{9/12 \times 60}$ | = | 36 f.p.s. - Velocity in forming zone 79. | [XI] |
| $\frac{1627}{16/12 \times 60}$ | = | 20 f.p.s. - Velocity normal to forming wire 80. | [XII] |
| $150 - 70$ | = | 80 p.f.s. - Velocity vector | [XIII] |

-continued

| | | | |
|---|---|---|---|
| | | parallel to the screen 180. | [XIV] |
| $\sqrt{80^2 + 18^2}$ | = | 82 f.p.s. - Air velocity vector composite within housing 172. | |
| 4.65 − 4.43 | = | .22 lbs./min. - Amount of fiber removed through separator slot 179. | [XV] |

Figure 6:
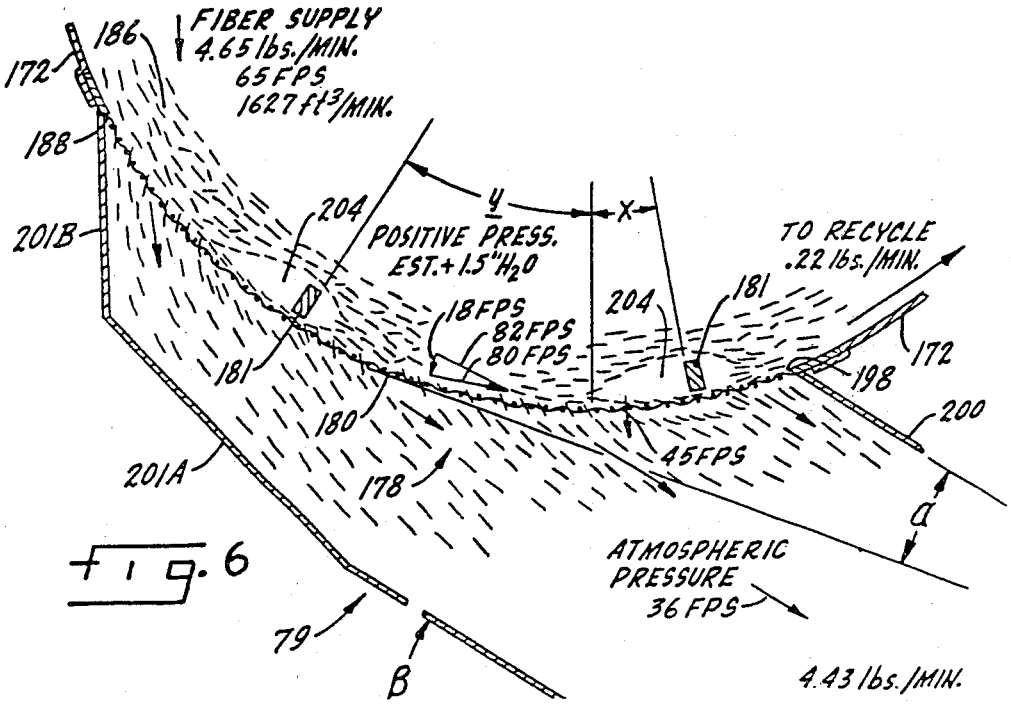
FIG. 6 is an enlarged, fragmentary side elevational view here depicting in diagrammatic form the air/fiber stream as it moves through the rotor housing and slotted screen.

Keeping the foregoing supply and velocity relationships in mind, and upon consideration of FIGS. 2 and 6 conjointly, it will be appreciated that the individualized fibers, soft fiber flocs, and any aggregated fiber masses present in the feed mat 116 (FIG. 2) will be disaggregated and dispersed within the air stream passing through fiber transport duct 170 with essentially the same cross-directional mass quantum relationship as they occupied in feed mat 116. Under the assumed conditions, the air/fiber stream enters rotor housing 172 (FIG. 2) at approximately 65 f.p.s. (Eq. VIII) and at a fiber feed rate of 4.65 lbs./min. (Eq. II). The volume of air supplied to rotor housing 172—viz., 1,627 ft.$^3$/min. (Eq. II)—is such that a positive pressure of approximately 1.5" $H_2O$ is maintained within the housing 172. Since the forming zone 79 is maintained at atmospheric pressure, there exists a pressure drop on the order of 1.5" $H_2O$ across the screening means 180 through which the air-suspended fibers pass.

Although the air/fiber stream entering rotor housing 172 through inlet slot 171 is moving radially initially, rotation of the rotor assembly 175 (counterclockwise as viewed in FIGS. 2 and 6) tends to divert the fibers outwardly towards the periphery of housing 172 so as to form an annular aerated bed of fibers, as best illustrated at 186 in FIG. 6. Movement of the rotor bars 181 through the annular aerated bed 186 of fibers at a rotor bar tip velocity of 150 f.p.s. tends to accelerate the air-fiber stream from its entry velocity of 65 f.p.s. (Eq. VIII) to approximately 80 f.p.s., thus resulting in a relative velocity of 70 f.p.s. between the rotor bars 181 and the aerated bed 186 of fibers. However, because of the clearance of 0.18" between the rotor bars 181 and housing 172, and the relatively small effective area of the rotor bars, only minimal pumping action occurs and there is little or no tendency to roll fibers between the rotor bars 181 and either housing 172 or screening means 180. Therefore, there is little or no tendency to form pills; and, since only minimal mechanical disintegrating action occurs, curling or shortening of individualized fibers is essentially precluded. Rather, the rotor bars 181 sweep through the aerated bed 186 and across screening means 180, thus causing at least certain of the individualized fibers and soft fiber flocs within the aerated bed 186 to move through the screening means—such air-suspended fibers have a velocity vector normal to the screening means 180 of approximately 18 f.p.s. (Eq. IX) and a composite velocity vector of approximately 82 f.p.s. (Eq. XIV) directed towards screening means 180 at an acute angle—while, at the same time, sweeping nits and aggregated fiber masses over and beyond the screening means 180.

Since the rotor bars 181 are moving through the aerated bed 186 of fibers at a relative speed 70 f.p.s. faster than movement of the aerated bed, a negative suction zone of 1.7" $H_2O$ is generated in the wake of each rotor bar 181, as best illustrated at 204 in FIG. 6. Each such negative suction zone extends the full-width of the rotor housing 172 and is parallel to the axis of the rotor assembly 175. In the case of the rotor bars having a circular cross-section (not shown), the negative suction generated would be on the order of 3.0" $H_2O$. In either case, negative suction generated is sufficient to momentarily overcome the pressure drop of approximately 1.5" $H_2O$ across the screening means 180 and, as a consequence, normal flow of the air/fiber stream through screening means 180 ceases momentarily in the region of the screen beneath the negative suction zone 204. Immediately upon passage of each negative pressure zone 204, the positive pressure drop conditions of approximately 1.5" $H_2O$ are restored until the next rotor bar 181 passes thereover; thus permitting the individualized fibers and soft fiber flocs to again move toward the screening means 180 at a velocity of 18 f.p.s. (Eq. IX) normal to the screen and at a composite velocity vector of 82 f.p.s. (Eq. XIV) directed towards the screen at an acute angle and, ultimately, through the screen openings at approximately 45 f.p.s. (Eq. X).

Those individualized fibers, soft fiber flocs, and aggregated fiber masses within the aerated bed 186 of fibers which do not pass through the screening means 180 the first time they are presented thereabove are swept over and beyond the screening means 180 and, thereafter, past classifying air jet 194 (FIG. 2). Under the assumed conditions, the individualized fibers and soft fiber flocs tend to be diverted radially inward by the classifying air jet 194, while the undesired aggregated fiber masses are centrifugally and tangentially separated from the aerated bed 186 through full-width separator slot 179 at the rate of 0.22 lbs./min. (Eq. XV). Those individualized fibers and soft fiber flocs remaining in the aerated bed 186 after transit of separator slot 179 are then returned to the region overlying screening means 180, where they are successively acted upon by the rapid succession of pressure reversal conditions from full-width negative pressure zones 204 alternating with full-width zones of positive pressure drops until all such materials pass through the screening means 180 into forming zone 79.

Experimentation with air-laid, dry fiber, web forming systems embodying the features of the present invention has indicated that a wide range of results are attainable dependent upon the particular operating parameters selected.

For example, the rotor assembly 175 may be formed with n rotor bars 181 where n equals any whole integer greater than "1". However, it has been ascertained that fiber throughput—a limiting constraint when attempting to maximize productivity—is a function of rotor speed multiplied by the square root of the number of rotor bars employed—i.e., fiber throughput: $f(\text{RPM} \times \sqrt{\text{No. of rotor bars } \mathbf{181}})$. This relationship will, of course, vary with the particular screen employed, and has been graphically illustrated in FIG. 12.

Figure 8:
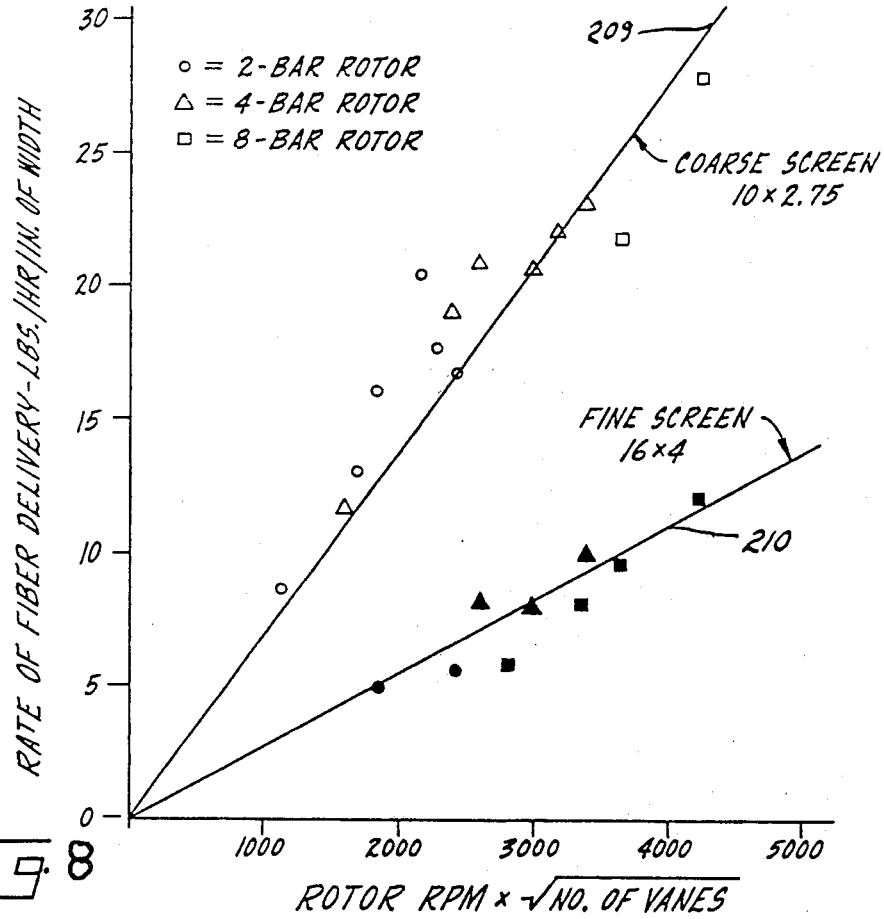
FIG. 8 is a graphic representation of the functional relationships existing between fiber throughput for specific representative screen designs and rotor assembly operating parameters.

Thus, the line 209 (FIG. 8) represents the Regressor, or "line-of-best-fit", from which functional relationships between throughput and rotor speed can be determined when using a coarse wire screen of the type described above. Similarly, the line 210 represents the same functional relationships when using a fine wire screen of the type described above. The data thus corroborates experimental findings that rotor RPM can be reduced while fiber throughput is maintained, or even increased, by going from a 4-bar rotor assembly 175' to an 8-bar rotor assembly 175. However, when using an 8-bar rotor assembly 175, the forming system seems to be less tolerant of mismatches between forming air and rotor speed; and where such mismatches occur, fibers tend to accumulate on the sidewalls 199 of the forming zone 79. This is readily corrected by reducing rotor speed, normally by less than 10%, while maintaining forming air constant.

It has been found that a 2-dimensional air-laid web forming system embodying features of the present invention will, when operating at a proper balance of fiber supply, forming air supply, and rotor speed, not only deliver maximum fiber throughput with minimum recycle, but, moreover, will exert a "healing effect" on basis weight non-uniformities entering the forming head 75 (FIG. 2). That is, the screen 180, when properly loaded with a moving or transient aerated bed 186 of fibers (FIG. 6), acts as a membrane which tends to equalize or even out the passage of fibers through adjacent incremental widths of the screen. Such "healing effect" is only operative over distances of six inches (6") or less.

Referring to Table I, it will be observed that a single forming head 75 embodying the features of the present invention—e.g., the type shown in FIGS. 1 and 2—and having a semi-cylindrical screen 18" in circumferential length, is capable of producing webs having basis weights ranging from 14–40 lbs./2880 ft.$^2$ at forming wire speeds ranging from about 911 f.p.m. to about 319 f.p.m.

TABLE I

2-DIMENSIONAL FORMER CAPACITIES IN ACCORDANCE WITH THE INVENTION[1]

| Basis Weight lbs./2800 ft.$^2$ | Product Type | Forming Wire Speed - ft./min. No. of Forming Heads 1 | 2 | 3 |
|---|---|---|---|---|
| 14 | Bath Tissue | 911 | 1821 | 2737 |
| 17 | Facial Tissue | 750 | 1500 | 2250 |
| 26 | Towel | 490 | 981 | 1471 |
| 34 | Towel | 375 | 750 | 1125 |
| 40 | Towel | 319 | 638 | 956 |

Figure 9:
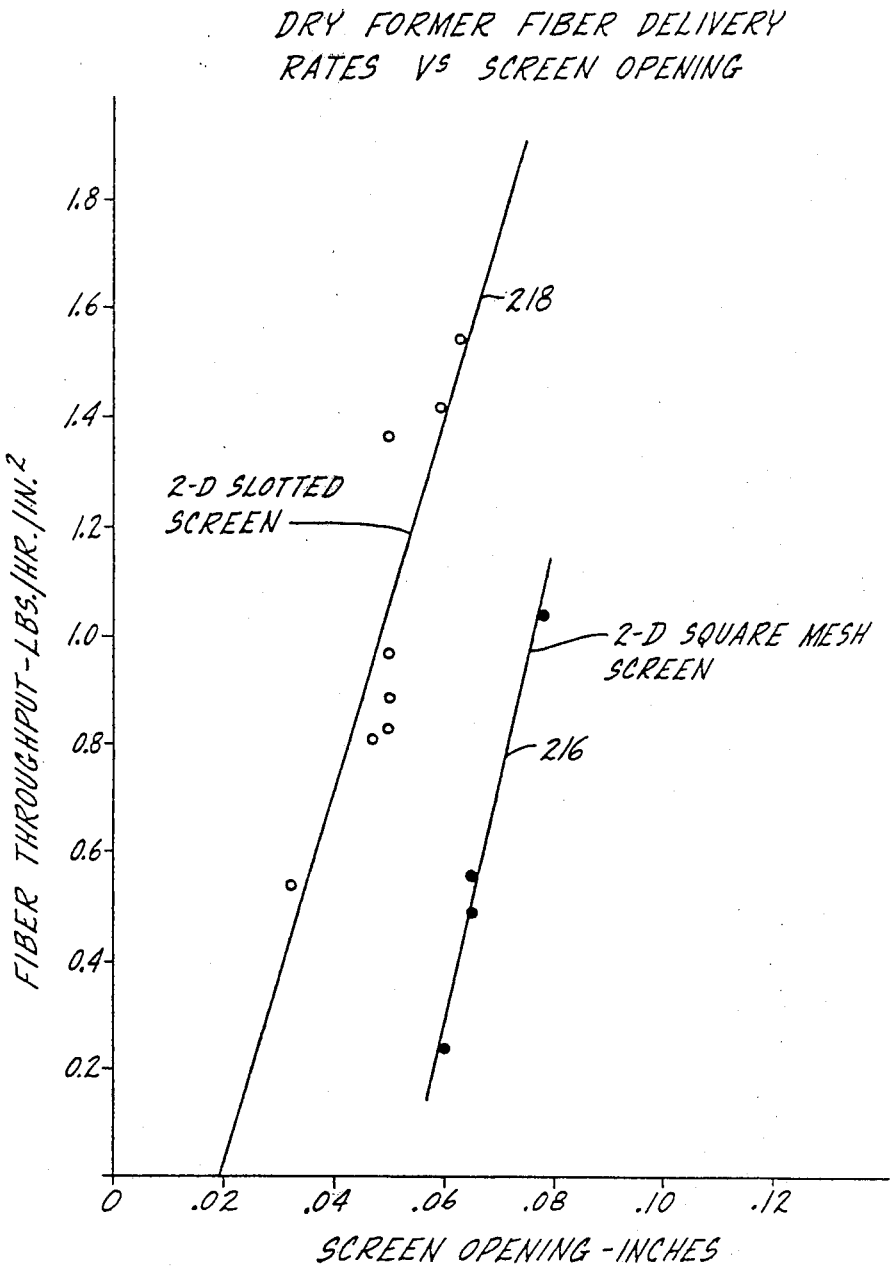
FIG. 9 is a graphic representation depicting the relationship between fiber delivery rates and both woven square-mesh screens and slotted screens.

[1]The data set forth in the Table I is based upon a fiber throughput capacity of 1.23 lbs./hr./in.$^2$ for a single forming head of the type shown at 75 in FIGS. 1 and 9, and which uses a relatively fine screen 180 18" in circumferential length and having a screen opening of 0.050".

Standards have been established by the assignee of the present invention for subjectively classifying the nit levels in air-laid webs formed of dry fibers. Such subjective standards are based upon visual inspection of the webs and comparison thereof with existing webs having differing nit levels which have been subjectively rated as "0" (excellent), "1" (good), "2" (acceptable), "3" (poor), "4", "5" and "6" (all unacceptable).

The ensuing portion of the present specification includes a discussion of the effects of varying various system parameters when utilizing slotted screens in accordance with the present invention, as well as when utilizing woven square-mesh screens. The Examples given are of actual experimental runs made with the equipment and have been randomly selected solely for the purpose of illustrating the effect of varying one or more of the operating parameters. No effort has been made to optimize operating conditions for each different given Example; although, certain of the Examples do reflect sets of operating parameters which either approach optimized conditions, are at or about optimized conditions, or somewhat exceed optimized conditions. Data for the various parameters for each of the Examples given are set forth in tabular form in Tables II and III inclusive. Examples I–III, represent operating parameters when utilizing woven square-mesh screens; whereas Examples IV–X represent operating parameters for a web forming system utilizing slotted screens in accordance with the present invention.

It should be noted that in Table II under the category "Product Made", Examples I, II and III have been designated as "Exp."—i.e., "Experimental". This designation has been used simply because the system parameters were not set with any specific product or end use in mind; rather, the web being formed was considered to be an "experimental" web. However, reference to the data for web basis weight reveals that the experimental webs of Examples I and II are suitable for facial tissue, while the experimental web of Example III is suitable for toweling.

Forming wire speeds and fiber throughput—the principal indicators of productivity—are of particular interest when evaluating the forming process used to form the webs of Examples I, II and III. In the case of Example I, for example, fiber throughput of 0.49 lbs./hr./in.$^2$ and forming wire speed of 300 f.p.m. were achieved utilizing a single forming head 75. Both parameters are approximately 40% of the anticipated average maximum production capacity set forth in Table I. In the case of the web formed in Example II, fiber throughput of 0.24 lbs./hr./in.$^2$ and forming wire speed of 150 f.p.m. represent approximately 20% of the anticipated average maximum production capacity.

TABLE II

| Example No. | I | II | III | IV | V |
|---|---|---|---|---|---|
| Run No. | 2899 | 2940 | 2942 | 1035 | 1025 |
| Fiber Type[1] | NSWK | NSWK | NSWK | NSWK | NSWK |
| Fiber Feed Rate - lbs./in./hr.$^2$ | 9.8 | 4.6 | 20.3 | 17.1 | 17.0 |
| Top Air Supply - ft.$^3$/min./in. | 112 | 115 | 115 | 107 | 107 |
| Air-to-Fiber Ratio - ft.$^3$/lb. | 689 | 1500 | 331 | 375 | 377 |
| No. of Rotors | 1 | 1 | 1 | 1 | 1 |
| No. of Rotor Bars/Rotor | 8 | 8 | 8 | 8 | 8 |
| Rotor Speed - RPM | 1200 | 1550 | 1600 | 1400 | 1800 |
| Screen Type | 10 × 10 | 12 × 12 | 8 × 8 | 11 × 2.5 | 11 × 2.5 |
| Screen Opening - Inches | .065 | .060 | .078 | .050 | .050 |
| % Open Screen Area | 42.3 | 51.8 | 38.9 | 43.6 | 43.6 |
| Former Pressure - Inches $H_2O$ | 1.85 | 1.5 | 3.0 | 1.1 | 1.6 |
| % Fiber Recycled | 10.2 | 7.5 | 7.9 | 5.8 | 5.3 |
| Amount Fiber Recycled - lbs./in./hr. | 1.0 | 0.35 | 1.6 | 1.0 | 0.9 |
| Fiber Throughput - lbs./hr./in.$^2$ | .49 | .24 | 1.04 | .89 | .89 |
| Classifying Air - ft.$^3$/min./in. | 1.3 | 1.4 | 2.1 | 2.2 | 2.2 |
| Forming Wire Speed - ft./min. | 300 | 150 | 500 | 525 | 500 |
| Product Made | Exp. | Exp. | Exp. | Facial Tissue | Facial Tissue |

TABLE II-continued

| | | | | | |
|---|---|---|---|---|---|
| Basis Weight - lbs./2880 ft.$^2$ | 16.9 | 17.6 | 22.7 | 17.7 | 18.6 |
| Coefficient of Variation - C.D. % | 3.1 | 1.8 | 2.2 | 2.1 | 7.1 |
| Tensile - Gms./3" C.D. Width | 505 | 357 | 763 | 335 | 371 |
| Nit Level | 1.0 | 0 | 1.0 | 1.1 | 1.6 |

[1]NSWK is Northern Softwood Kraft.
[2]Fiber feed rates as stated represent maximum former capacity for the operating parameters established.

In the case of Example III, the web produced was substantially heavier than the webs of Examples I and II discussed above, having a basis weight of 22.7 lbs./2880 ft.$^2$. Forming wire speed of 500 and throughput of 1.04 lbs./hr./in.$^2$ are significantly improved over the comparable parameters for Examples I and II. While the throughput and forming wire speed data set forth in Example III is for a web having a basis weight of 22.7 lbs/2880 ft.$^2$, such data is equivalent to forming a web of 17 lbs./2880 ft.$^2$ at approximately 668 ft./min.

When employing a slotted screen in accordance with the present invention such, for example, as that shown in FIG. 4, the results in terms of increased prodductivity are dramatic. This may be readily demonstrated by reference to Examples IV and v (Table II), and Examples VI through X (Table III), and comparing the data there given with that set forth in connection with Examples I–III (Table II). Thus in Examples IV–X the recycle percentages range from a high of 5.8% (Example IV) to a low of 2.7% (Example VI). In Examples IV through VI, facial tissue grade webs were produced in accordance with the invention having basis weights ranging from 17.0 lbs./2880 ft.$^2$ (Example VI) to 18.6 lbs./2880 ft.$^2$ (Example V); while in Examples VII through X, toweling grade webs were produced having basis weight ranging from 22.3 lbs./2880 ft.$^2$ (Example X) to 44.5 lbs./2880 ft.$^2$ (Example IX). Fiber throughput for the webs of Examples IV through X ranged from 0.89 lbs./hr./in.$^2$ (Examples IV and V) to 1.55 lbs./hr./in.$^2$ (Example VII).

were rated "adequate", although nit level was not quite as good as in the case of Examples I–III. Coefficients of variation for Examples IV through X were 2.1%, 7.1%, 4.8%, 3.5%, 3.9%, 4.4%, and 1.1%, respectively, as compared with Examples I–III where the coefficients of variation were 3.1%, 1.8% and 2.2%. The coefficient of variation for Example V of 7.1% is realtively poor and would not generally be acceptable for premium grade facial tissues.

Comparisons of the results attained at the parameter settings for Examples VI and VII (Tabel III) with the anticipated average maximum forming capacities reveals that in both cases the rate or productivity attained substantially exceed the anticipated average maximum capacity for the forming system of the present invention. Thus, while it would normally be anticipated that a single forming head 75 could produce a web having a basis weight of 17 lbs./2880 ft.$^2$ at a forming wire speed of 750 f.p.m. (See, Table I) in the Case of Example VI a 17 lb./2880 ft.$^2$ basis weight web was produced at a forming wire speed of 800 f.p.m.—i.e., approximately 6.6% faster than the average maximum productivity rate anticipated. Nevertheless, the resulting air-laid web was entirely satisfactory for use as a premium grade quality facial tissue. Similarly, the web of Example VII, which has a basis weight of 27.3 lbs./2880 ft.$^2$ suitable for toweling, was actually produced at 590 f.p.m. on a single forming head 75, whereas the anticipated average maximum forming speed for such a web would normally be on the order of 467 f.p.m.—i.e., the actual rate

TABLE III

| Example No. | VI | VII | VIII | IX | X |
|---|---|---|---|---|---|
| Run No. | 2717 | 2861 | 2908 | 2909 | 2946 |
| Fiber Type[1] | NSWK | NSWK | NSWK | NSWK | NSWK |
| Fiber Feed Rate - lbs./in./hr/$^2$ | 26.3 | 28.9 | 18.4 | 18.3 | 26.0 |
| Top Air Supply - ft.$^3$/min./in. | 133 | 131 | 129 | 129 | 119 |
| Air-to-Fiber Ratio - ft.$^3$/lb. | 312 | 271 | 420 | 423 | 275 |
| No. of Rotors | 1 | 1 | 1 | 1 | 1 |
| No. of Rotor Bars/Rotor | 4 | 8 | 8 | 8 | 8 |
| Rotor Speed - RPM | 1700 | 1600 | 1000 | 1000 | 1550 |
| Screen Type | 10 × 2.75 | 9 × 2.5 | 11 × 2.5 | 11 × 2.5 | 11 × 2.5 |
| Screen Opening - Inches | .059 | .063 | .050 | .050 | .050 |
| % Open Screen Area | 46.4 | 45.5 | 43.6 | 43.6 | 43.6 |
| Former Pressure - Inches $H_2O$ | 1.6 | 2.0 | 0.95 | 0.95 | 1.7 |
| % Fiber Recycled | 2.7 | 3.1 | 5.4 | 4.9 | 4.6 |
| Amount Fiber Recycled - lbs./in./hr. | 0.7 | 0.9 | 1.0 | 0.9 | 1.2 |
| Fiber Throughput - lbs./hr./in.$^2$ | 1.42 | 1.55 | .97 | .97 | 1.37 |
| Classifying Air - ft.$^3$/min./in. | 2.6 | 1.6 | 1.6 | 1.4 | 1.8 |
| Forming Wire Speed - ft./min. | 800 | 590 | 375 | 225 | 640 |
| Product Made | Exp. | Exp. | Towel | H.D. Towel | Exp. |
| Basis Weight - lbs./2880 ft.$^2$ | 17.0 | 27.3 | 26.7 | 44.5 | 22.3 |
| Coefficient of Variation - C.D. % | 4.8 | 3.5 | 3.9 | 4.4 | 1.1 |
| Tensile - Gms./3" C.D. Width | 521 | 1045 | 265 | 559 | 705 |
| Nit Level | 2.0 | 0.3 | 1.0 | 0 | 2.0 |

[1]NSWK is Northern Softwood Kraft.
[2]Fiber feed rates as stated represent maximum former capacity for the operating parameters established.

In terms of formed web characteristics, the nit levels of "0" ("excellent") "0.3" ("excellent"), "1.0" and "1.1" ("good") for Examples IX, VII, VIII and IV, respectively, compare favorably to the nit levels for Examples I–III. Nit levels for Examples V, VI and X were "1.6", "2.0" and "2.0", respectively; and, as such, those webs of productivity achieved exceeded the anticipated average maximum capacity by approximately 26.3%. In the case of Examples VI and VII, the fact that productivity rates actually achieved somewhat exceed the average anticipated maximum rates set forth in Table I is believed to be attributable in large part to the fact that relatively coarse screens were used in making the webs of such Examples—viz., relatively coarse screens having 0.059" (Example VI) and 0.063" (Example VII) openings, rather than fine screens having 0.050" openings and which formed the basis for the data set forth in Table I. Experimental data such as that set forth in Table III suggests that for heavyweight towel products, relatively coarse screens will tend to improve productivity rates without giving rise to any serious problems in terms of operation or web characteristics. The characteristics of the Example VII web in terms of nit level, coefficient of variation and basis weight are again such that the web produced was of excellent quality suitable for use in premium grade towelling.

As in the case of the woven square-mesh screen comparisons (Examples I, II and III, Table II) where the best result in terms of productivity ws achieved with the coarsest screen—viz., an 8×8 woven square-mesh screen having screen openings 0.078" in width (Example III)—in the slotted screen comparisons the best result in terms of productivity was also achieved when using a relatively coarse slotted screen—viz., a 9×2.5 screen having screen openings of 0.063" in width (Example V).

Examples III and VII-X are of interest principally for their showing of typical operating parameters suitable for forming relatively heavy basis weight webs which can be used for toweling products. Considering Example III, it will be noted that when utilizing an 8×8 woven square-mesh screen, a web having a basis weight of 22.7 lbs/2880 ft.$^2$ was produced at a forming wire speed of 500 f.p.m. Considering Examples VII-X, it will be noted that the webs there formed in accordance with the invention had basis weights ranging from 22.3 lbs./2880 ft.$^2$ (Example X), to 44.5 lb./2880 ft.$^2$ (Example XI) coefficients of variation ranging from 1.1% (Example X) to 4.4% (Example IX), and nit levels of "0", "0.3", "1.0" and "2.0" for Examples IX, VII, VIII and X, respectively; all of such basis weights, coefficients of variation and nit levels being entirely suitable for commercial grade, high quality toweling products. The webs of Examples VIII and IX were formed at productivity rates of approximately 78.5% of the average minimum productivity rates anticipated. The web of Example VII (as previously described) was formed at a speed approximately 26.3% in excess of the anticipated the web of Example X was formed at a speed approximately 12% in excess of the anticipated average maximum capacity.

It is believed that the numerical data set forth in connection with Examples I through X clearly evidences the significant improvement obtained in fiber throughput—i.e., productivity rate—when utilizing slotted screens in accordance with the present invention as contrasted with using conventional woven square-mesh screens of the type shown in FIG. 3. However, the dramatic improvement in throughput is made even more evident upon inspection of that data as reproduced in graphic form in FIG. 9. Thus, as here shown fiber throughput for each of Examples I through X in lbs./hr./in$^2$ has been plotted versus the screen opening size in inches used with each Example. The line 216 is thus representative of fiber throughput when using woven square-mesh screens in a 2-dimensional web forming system and the line 218 represents fiber throughput when using a slotted screen according to the present invention.

The productivity rates of the present invention may be readily set forth as follows: A web having a basis weight of (x) (17 lbs./2880 ft.$^2$) where "x" is equal to any desired whole or fractional value, can be produced at a forming wire 80 speed of 750 f.p.m. divided by "x"; or, $$(x)\ (17\ \text{lbs./2880 ft.}^2) = \text{forming wire speed}\ \frac{(750\ \text{f.p.m.})}{x} \qquad \text{(XVI)}$$

Similarly, where N forming heads 75A–75N are used, the foregoing relationship of web basis weight to forming wire 80 speed may be expressed as follows:

$$(x)\ (17\ \text{lbs./2880 ft.}^2) = \text{forming wire speed}\ \frac{(N)\ (750\ \text{f.p.m.})}{x} \qquad \text{(XVII)}$$

Based on the experimental data reported herein, it is evident that the present invention provides a dramatic improvement in fiber throughput capacity for the forming head. Thus, the data reflects fiber throughput ranging from somewhat in excess of 0.5 lbs./hr./in.$^2$ (Example IV) to in excess of 1.50 lbs./hr./in.$^2$ (Example VII) when working with cellulosic wood fibers and a former 75 24" in diameter. Moreover, it should be noted that the foregoing range of from 0.5 lbs./hr./in.$^2$ to at least 1.50 lbs./hr./in.$^2$ reflects efforts made to form high quality, lightweight tissue and/or towel grade products. Where product quality in terms of, for example, nit level can be accepted at lower quality levels, it can be expected that fiber throughput will exceed and, may substantially exceed, the level of 1.50 lbs./hr./in.$^2$. Similarly, when actual production experience has been acquired, it can be expected that fiber throughputs will be regularly achieved which do exceed the level of 1.50 lbs./hr./in.$^2$, and such improved results may also be achieved when the system is scaled up in size—e.g., to rotor assemblies on the order of 36" in diameter. Therefore, the phrase "to at least 1.50 lbs./hr./in.$^2$" as used herein and in the appended claims is not intended to place an upper limit on throughput capacity.

Those skilled in the art will appreciate that there has herein been described a novel web forming system characterized by its simplicity and lack of complex, space-consuming, fiber handling equipment; yet, which is effective in forming air-laid webs of dry fibers at commercially acceptable production speeds irrespective of the basis weight of the web being formed. At the same time, the absence of cross-flow forces insures that the finished web possesses the desired controlled C.D. profile which may be either uniform or non-uniform.

What is claimed is:

1. The method of forming an air-laid web of dry fibers having a basis weight of from 7.5 to 50 pounds per 2880 square feet comprising:

(a) delivering dry fibrous materials comprising individualized fibers and aggregated fiber masses suspended in an air stream to a rotary forming head having a forming chamber with a plurality of rotating rotor bars therein positioned over a forming surface;

(b) conveying the dry fibrous materials through the forming head in a moving aerated bed of individualized dry fibers and aggregated fiber masses and in an environment maintained substantially free of fiber grinding and disintegrating forces;

(c) continuously separating and discharging from the forming head from 1% to 10% of the fibrous materials from the aerated bed having a bulk density in excess of 0.2 g/cc.

(d) discharging the individualized fibers from the forming head through a high capacity slotted screen at a fiber throughput rate from about 0.5 lbs./hr./in.$^2$ to about 1.50 lbs./hr./in.$^2$;

(e) conveying said individualized fibers from said forming head through an enclosed forming zone to a moving foraminous forming surface whereby, an air-laid web of individualized fibers is formed on said foraminous forming surface.

2. The method of claim 1 wherein the individualized fibers are conveyed from the forming head at a rate of approximately 1.23 lbs./hr./per square inch of screen surface, and the relationship of the basis weight to the forming surface speed is in accordance with the following set of operating parameters: basis weight=(×) (17 lbs./2880 ft.$^2$) at a forming surface speed of about (750 f.p.m./x) (where x equals any whole or fractional number).

3. The method of claim 1 wherein from 1% to 5% of the fibrous materials are separated from the aerated bed and discharged from the forming head.

4. The method of claim 1, wherein steps (a), (b), (c) and (e) are carried out in an environment essentially devoid of cross-flow forces such that said fiberous material and said web produced therefrom is maintained with uniform cross-direction basis weight.

5. The method of claim 2, wherein steps (a), (b), (c), and (e), are carried out in an environment essentially devoid of cross-flow forces such that said fibrous material of said web produced therefrom is maintained with uniform cross-direction basis weight.

6. The method of claim 1, wherein said rotor bars have a speed of rotation approximately twice the speed of rotation of said air-suspended fibrous materials within said rotary forming head, whereby a negative pressure zone is created behind each rotor bar.

7. The method of claim 6, wherein a positive pressure of from 0.5" to 3.0" of water is maintained within said forming chamber, said positive pressure creating a pressure drop across said slotted screen of from 0.5" to 3.0" of water.

8. The method of claim 7, wherein said negative pressure zone is equal to or greater than the pressure drop across said slotted screen, thereby disrupting the flow of fibers through said slotted screen and lifting fibrous materials off said slotted screen.

9. The method of forming a quality web of air-laid dry fibers on a high speed production basis comprising the steps of:

(a) delivering dry fibrous materials to a forming head positioned over a forming surface;

(b) conveying the dry fibrous materials through the forming head in a rapidly moving aerated bed of individualized fibers, soft fiber flocs and aggregated fiber masses and in an an environment maintained substantially free of fiber grinding and disintegrating forces;

(c) continuously separating from 1% to 10% of the fibrous materials delivered to the forming head from the aerated bed with the materials being separated including those having a bulk density in excess of 0.2 g/cc. so as to maximize the separation of aggregated fiber masses from the aerated bed;

(d) discharging such separated fiberous materials including the aggregated fiber masses contained therein from the forming head;

(e) discharging the individualized fibers and soft fiber flocs through a high capacity slotted screen;

(f) conveying the individualized fibers and soft fiber flocs discharged through the slotted screen at a fiber throughput rate anywhere in the range of 0.5 lbs./hr./in.$^2$ to at least 1.50 lbs./hr./in.$^2$ through an enclosed forming zone towards the moving foraminous forming surface in a rapidly moving air stream;

(g) air-laying the individualized fibers and soft fiber flocs on the moving foraminous forming surface so as to form an air-laid web of randomly oriented dry individualized fibers and soft fiber flocs on the forming surface with such web having a nit level of from "0" to "3"; and, (h) moving the foraminous forming surface at a controlled and selected speed so as to produce an air-laid web having a nit level of from "0" to "3" and any specific desired basis weight in lbs./2880 ft.$^2$ ranging from at least as low as 13 lbs./2880 ft.$^2$ to in excess of 40 lbs./2880 ft.$^2$.

* * * * *